United States Patent [19]

Gahlau et al.

[11] Patent Number: 4,705,139

[45] Date of Patent: Nov. 10, 1987

[54] SOUND INSULATION PART FOR SURFACES

[75] Inventors: Heinemann Gahlau, Celle; Manfred Hoffmann, Nienhof; Norbert Seemann, Nienhagen, all of Fed. Rep. of Germany

[73] Assignee: Dr. Alois Stankiewicz GmbH, Adelheidsdorf, Fed. Rep. of Germany

[21] Appl. No.: 904,902

[22] Filed: Sep. 8, 1986

[30] Foreign Application Priority Data

Sep. 6, 1985 [DE] Fed. Rep. of Germany ..... 3531886

[51] Int. Cl.[4] ..... E04B 1/82

[52] U.S. Cl. ..... 181/290; 181/286; 181/288; 181/294

[58] Field of Search ..... 181/286, 288, 285, 290, 181/292, 294

[56] References Cited

U.S. PATENT DOCUMENTS

| | | | |
|---|---|---|---|
| 1,801,786 | 4/1931 | Woodall et al. | 181/292 X |
| 2,116,771 | 5/1938 | Seaman | 181/290 X |
| 2,768,091 | 10/1956 | Cubberley | 181/290 X |
| 4,167,598 | 9/1979 | Logan et al. | 181/288 X |
| 4,479,992 | 10/1984 | Haeseker et al. | 181/288 X |

FOREIGN PATENT DOCUMENTS

| | | |
|---|---|---|
| 2750439 | 5/1979 | Fed. Rep. of Germany . |
| 7929637 | 1/1980 | Fed. Rep. of Germany . |
| 2921050 | 11/1980 | Fed. Rep. of Germany . |
| 2732483 | 5/1981 | Fed. Rep. of Germany . |
| 3030238 | 2/1982 | Fed. Rep. of Germany . |
| 8201511 | 9/1982 | Fed. Rep. of Germany . |
| 8336676 | 3/1984 | Fed. Rep. of Germany . |
| 3233654 | 3/1984 | Fed. Rep. of Germany . |
| 2758041 | 10/1985 | Fed. Rep. of Germany . |
| 3412432 | 10/1985 | Fed. Rep. of Germany . |

OTHER PUBLICATIONS

Page 73 of the book "Technische Larmabuehr" (Technical Noise Abatement), Warner Zeller (1950).

EPB-Mitteilung, 39,7 of the Fraunhofer-Institute Fur Bauphysik (1979).

"Intensitatsmessung im Kraftfahrzeuginnenraum mit einem kleinem Analogmessgerat" (Intensity Measurement in Motor Vehicle Interiors with a Small Analogue Measuring Instrument) VD1 Report, 526, pp. 137–151.

"Prufstandsuntersuchungen an Fahrzeugrorbauten als Basis fur Schallisolierungen" (Test Stand Tests on Vehicle Fore-Parts as a Basis for Sound Insulation) PAGA 1984.

*Primary Examiner*—Benjamin R. Fuller

*Attorney, Agent, or Firm*—Scully, Scott, Murphy & Presser

[57] ABSTRACT

A sound insulation part for surfaces with known source-sink distribution, in particular in passenger spaces of motor vehicles, is provided, which is designed as a mass-spring system with discontinuities incorporated therein for the purpose of converting sources into sinks. In order to achieve a particularly effective sound insulation with low mass or light weight, the sound insulation part contains, over limited parts of its surface, closed cells (1) embedded in the spring (foam 3) and encased in coils (2). These cells (1) can be directed towards the heavy layer (4) or the panel (8) which the part adjoins, or can be wholly or partly in the intermediate region. The cells (1) can be gas- or air-filled. The foils (2) advantageously have masses of about 25 to 150 g/m$^2$ of surface.

11 Claims, 4 Drawing Figures

SOUND INSULATION PART FOR SURFACES

TECHNICAL FIELD OF THE INVENTION

The invention relates to a sound insulation part for surfaces with known source-sink distribution, in particular for passenger spaces of motor vehicles, which is formed as a mass-spring system and into which discontinuities are incorporated in order to convert sources into sinks.

BACKGROUND OF THE INVENTION AND PRIOR ART

A known sound insulation part of this type (DE-GM 82 01 511) has at least one heavy layer and a springy layer between the heavy layer and the corresponding part of the motor vehicle or the like, such as a body panel, having grooves and/or depressions and/or knobs formed therein for the purpose of forming discontinuities. The depressions are preferably cup-shaped.

The purpose of such sound insulation parts is to achieve high noise comfort with the lowest possible weight.

For physical reasons, however, the possibilities of saving in mass with simultaneous noise reduction are limited with the known mass-spring systems, i.e. parts that are too light can no longer fulfil the requirements for noise comfort. Attempts have already been made to construct sound insulation parts of large surface area in such a way that parts of the surface with greater sound yield are equipped more intensely acoustically, e.g. through mass coating or proofing against solid-borne sound (cf DE-AS 27 32 483). According to another approach, sound sinks are subjected to a more intense treatment, such that the intensity vector of the sound radiation (corresponding to a sink), which is directed outwards from the inner passenger space, is augmented (cf DE-GM 83 36 676) by applying an additional soft spring to the sound sinks. These measures do not allow any saving in weight, so that the requirements for series production are still not optimal.

More recent investigations on sound fields in passenger cabins, in particular of cars, have been made primarily by consistently using and further developing the methods for measuring sound intensity or for measuring sound energy flux. With the help of such methods the source-sink distribution in a vehicle can be determined (cf in particular Kutter-Schrader, H., Betzhold, Ch. and Gahlau, H. "Intensitätsmessung im Kraftfahrzeuginnenraum mit einem kleinen Analogmessgerät" [Intensity measurement in motor vehicle interiors with a small analogue measuring instrument], VDI-Report, 526, p 137–151). These methods have further indicated how the vectorially directed sound energy flux emerging from the roof of a vehicle can be treated, by solid-borne sound proofing measures, so that the intensity vectors are markedly reduced and the disturbing low-frequency resonance vibration no longer occurs.

Proceeding from these considerations, it appears that starting-points for providing effective sound insulation using as small a mass as possible are: if the parts as a whole are light in weight, to provide them at the sound radiators with additional means, such as a thicker heavy layer, only on the parts of the surfaces recognised as to be treated, In particular, effective sound insulation can be expected if an alteration in the source-sink distribution is brought about such that the distribution of the sources and sinks obtained after the sound insulation measure is as uniform as possible, with strong sinks directly adjacent to the strong sources. With motor vehicle bodies it has, however, been found that powerful sound radiators (sources) must be converted into sinks.

With mass-spring systems of the kind mentioned it is known to achieve weight savings if the spring has gas-filled hollow chambers (cells) which are totally or partially enclosed by foil, these cells being distributed symmetrically over the whole surface of the sound insulation part (cf DE-OS NO. 27 50 439 and DE-GM 79 29 637). Through the uniform and symmetrical arrangement of the gas-filled cells, the whole spring becomes stiffer since gas-filled closed chambers become incompressible.

OBJECT OF THE INVENTION

Starting from here, it is an object of the invention to provide a sound insulation part of low weight (small mass) which has the desired property of converting sound sources into sound sinks.

SUMMARY OF THE INVENTION

This object is achieved according to the invention by embedding in the spring, over a limited part of the surface, closed cells which are encased in at least one foil.

In the case of mass-spring systems with a soft flexible heavy layer, employing foam or fibrous materials, the invention can with advantage be used as a complete shaped insulation part. Acoustically favourable effects like airborne sound absorption characteristics can additionally be taken into account. The finished insulation part can be installed as an independent formed part and can later be covered with the usual vehicle carpet, or it can be manufactured in combination with a carpet as a compact part.

As can be seen from the above explanations, a surface to be provided with the insulation part is first of all acoustically measured as a whole, for instance as a vehicle body, and specially with regard to the source-sink distribution. It is possible to proceed either from a basic measurement on a vehicle without sound insulation, or from a measurement on a vehicle with conventional series-production sound insulation. A preferred method consists in installing a vehicle fore-part, cut off behind the B-columns, in a testing stand and determining the intensity distribution over a sufficient number of part surfaces. This method is explained in the literature, in particular in Betzhold, Ch., Gahlau, H., and Hofele, G. "Prüfstandsuntersuchungen an Fahrzeugvorbauten als Basis für Schallisolierungen" [Test stand tests on vehicle fore-parts as a basis for sound insulations], DAGA '84. These tests are preferably carried out frequency-dependently, in order to determine exactly the source-sink distribution in the ignition frequency ranges which are found by experience to be particularly at risk. Proceeding from there, those places, or local surface regions, are then determined, in which the cells formed acccording to the application are to be embedded in the spring.

Indeed the expert already knew that mass-spring systems of the construction given above lead to some alteration in the source-sink distribution compared to the basic state in a vehicle, but because of the completely symmetrical arrangement usual until now, the distribution of the sources and sinks that then arose was not such that the desired result was obtained. In particular the distribution of the sources and sinks was not controllable.

With the invention it is important to coat the surfaces of the sound radiator partially with a system of sealed cells containing air or gas, in order to create discontinuities through which the sound energy flux vector can be directed outwards out of the passenger space so as to create a sink. These enclosed cells can for example be formed either by embedding appropriate commercial synthetic packaging foils in the foam material of the spring, or by manufacturing the cells for the purpose by inflation and jig welding of foils. Such cells, from which the contained gas or the contained air cannot escape, have the further advantage that they can be put in place, without great expenditure, during the manufacture of the foam section (foamed part), so that additional airborne sound absorbing properties can be deliberately exploited through the trapped gas volume. Moreover, the trapped volume of gas or air is incompressible, which gives the sound insulating cladding, i.e. the sound insulation, a locally high resistance to foot pressure. When sound energy is transmitted, e.g. from the car body side, i.e. the panel, on the one hand via the closed cells, the foam layer of the spring and the adjoining soft flexible heavy layer as mass, and on the other hand is also transmitted in regions outside these purposeful discontinuities through the uninterrupted foam, of which the thickness corresponds to the thickness of the entire spring, the differing speeds of sound in the cell and in the foam material result in a time delay that obviously leads to a phase displacement such that the desired conversion of the source into a sink in the region of the discontinuities is achieved. As will be explained in detail, the cells can be arranged directly on the heavy layer, directly on the panel or distributed at random inside the spring.

Through the local and purposeful incorporation of cells, according to the application, the desired uniform distribution of the sources and sinks can be achieved at the same time, so that acoustic short circuits between them can be effectively used for noise reduction in the vehicle with the use of relatively little mass. It was ascertained by a test that, by means of such a construction of a sound insulation part, a significant improvement of about 5 dB could be achieved in the ignition frequency range compared to conventional series production sound insulation parts of a vehicle, in the floor—end wall region, having a mass of 15 kg, while the total mass of the sound insulation part of the same surface area formed according to the application only amounted to 11.5 kg, As explained, by the formation and arrangement of the cells according to the application, and in particular also through alteration of the volume, special airborne sound absorbing effects can also be achieved, i.e. the airborne sound absorption of a foam material, which is known to be dependent on frequency, and which has a maximum at a frequency corresponding to the structure of the foam, can, by the local and purposeful incorporation of the cells according to the application, be given a secondary maximum, so that the overall effective absorption frequency band is extended. An approximate calculation of the tuning of cells sealed all round by foils, with regard to pure airborne sound absorption, is possible with the help of Zeller, W. "Technische Lärmabwehr" [Technical Noise Abatement], Publishers Alfred Fröhner, Stuttgart, (1950); see in particular the comparison on p 73, although the boundary conditions indicated in this paper do not apply with the configuration according to the application.

Sound insulation parts covered with a spring thickness of 25 mm foam with a heavy layer of about 6 $kg/m^2$ were tested. In the region of the discontinuities tightly sealed air-filled cells directed to the panel side and having an average thickness of about 12 mm. were incorporated. The foam material employed possessed a dynamic modulus of elasticity $E=1.10^5\ Nm^{-2}$ with a density of 70 $kg/m^3$. The speed of propagation of sound in the foam in the frequency range of interest, between 100 and 2000 Hz, is brought to values between 10 and 40 $ms^{-1}$, while the speed of propagation in the air (in the cells) amounts as is known to 330 $ms^{-1}$. By filling the closed cells with gases other than air the effect described can be influenced as desired.

BRIEF DESCRIPTION OF THE DRAWINGS

The invention is explained in more detail with reference to the exemplary embodiments shown in the drawing, in which.

DETAILED DESCRIPTION OF PREFERRED EMBODIMENTS OF THE INVENTION

Figure 1:
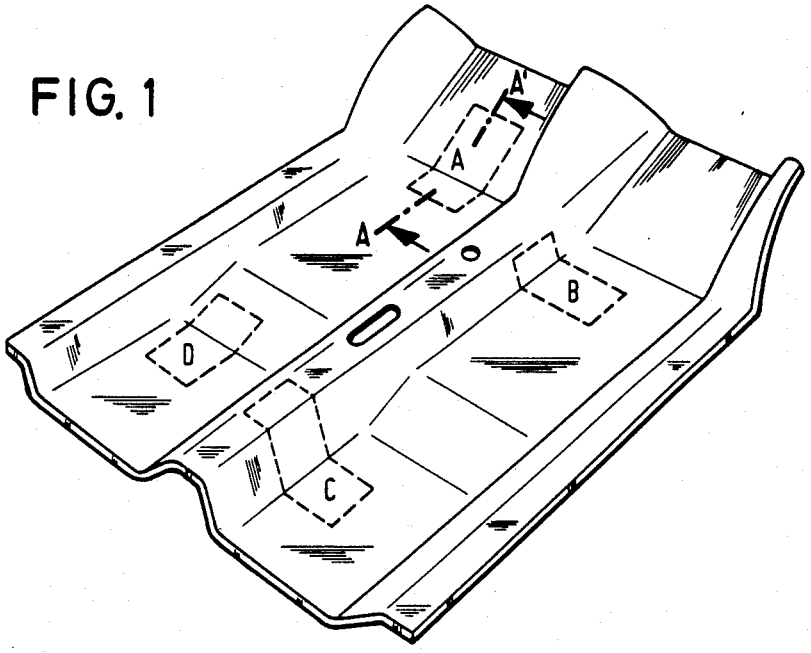
FIG. 1 shows in perspective a sound insulation part for covering the frontal floor regions in a vehicle.

FIG. 1 shows a sound insulation part for covering the end wall —floor regions in a vehicle, to which the invention can be applied. In particular, dashed lines in FIG. 1 indicate fields A, B, C and D, in which localities the construction according to the invention of the sound insulation part is of significance, i.e., those fields in which the precautions according to the invention are taken in order to achieve the reversal of sources into sinks that is desired there. The arrangement of these fields A, B, C and D is based on the results of sound energy flux measurements made with the aim of ascertaining the source-sink distribution in a particular insulation state of the vehicle, e.g. the basic state without insulation, in order to go on from there to achieve an improvement with the help of the invention.

Figure 2:
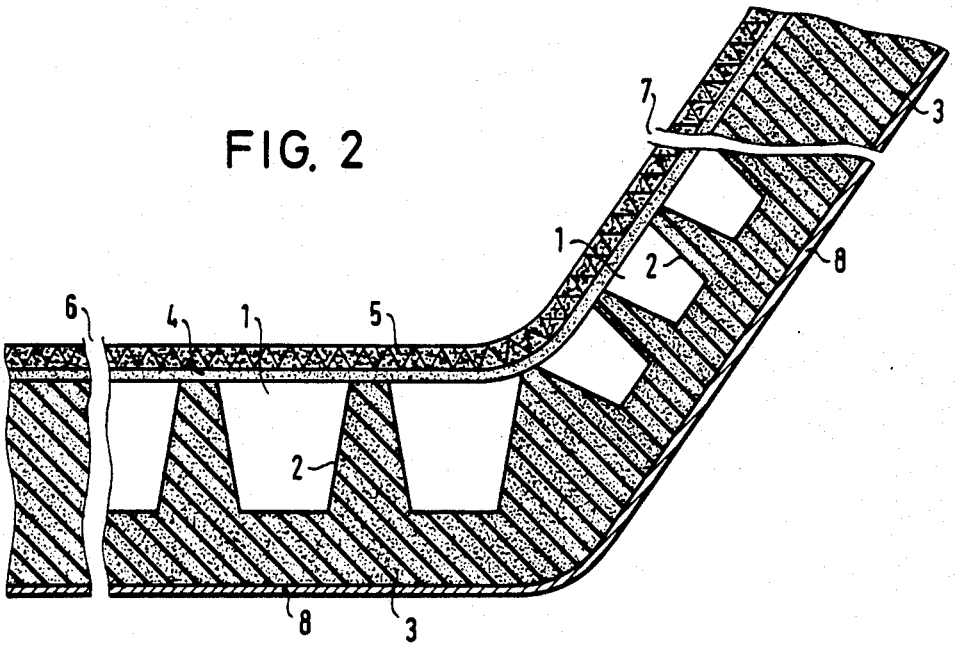
FIG. 2 shows the section A–A' according to a first exemplary embodiment of the invention.

FIG. 2 shows an exemplary embodiment in which cells 1 of regular geometrical shape and encased by a foil 2, are embedded in a foam material 3 of the spring of the insulation part. Adjoining this is a heavy layer 4 and then a carpet 5. Points of connection 6 and 7 to adjacent sections of the whole insulation part are indicated, for instance according to FIG. 1. The insulation part is applied to a panel 8 of a vehicle body.

According to FIG. 2 the cells 1 are of strict geometrical form but can be of different sizes (volumes). In the exemplary embodiment according to FIG. 2 the cup-shaped, geometrically regular cells 1 directly adjoin the heavy layer 4.

Figure 3:
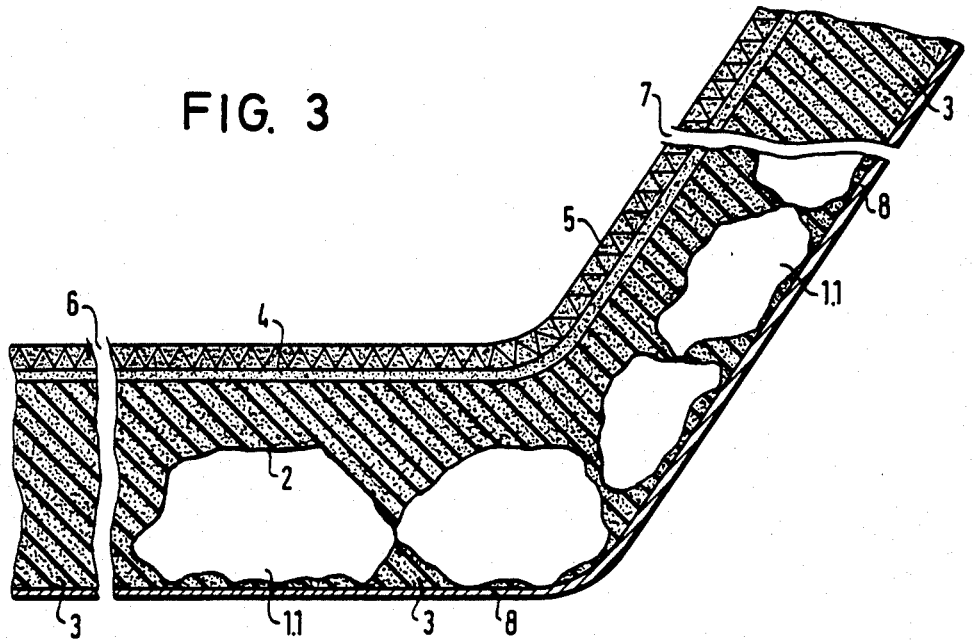
FIG. 3 shows another embodiment of the invention.

FIG. 3 shows an otherwise similar embodiment, in which the cells 1.1, which are likewise enclosed by a foil 2, are irregularly shaped and, moreover, are arranged near the body panel 8 inside the foam material 3. The cells 1.1 of the exemplary embodiment according to FIG. 3 are essentially cushion shaped. The initial strictly geometrical shape before insertion into the foam material is distorted by the foam pressure, so that the irregular shape shown in FIG. 3 results. However the acoustic result remains the same, and moreover, by reason of the irregularity of the shape and hence of the effective depth or thickness of the cells 1.1, favourable widening of the frequency range is found to result.

Figure 4:
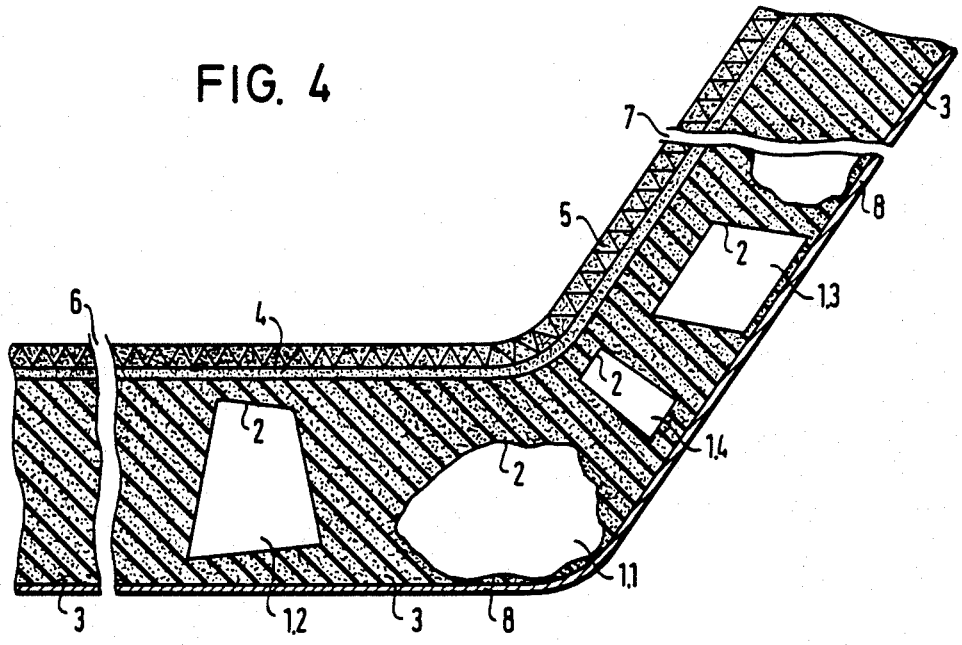
FIG. 4 shows a third embodiment of the invention.

FIG. 4 shows an embodiment in which the sound insulation part contains both geometrically regularly shaped as well as irregularly shaped cells 1.2, 1.3, 1.4 or 1.1, which are likewise enclosed by a foil 2. The spatial arrangement of the individual cells in each case can be near the heavy layer 4, as in the design according to FIG. 2, near the panel 8, in the design according to FIG. 3, or, as portrayed in particular in FIG. 4 in the case of the cells 1.2 and 1.4, in the intermediate area between heavy layer 4 and panel 8. What is essential is rather the acoustic effect to be obtained.

Sound insulation parts provided locally with cells according to one of the exemplary embodiments, for instance the exemplary embodiments according to FIG. 2, 3 or 4, can be manufactured separately and laid on the panel 8 and subsequently lined with the carpet 5. The carpet 5 can also be manufactured integrally with the sound insulation part (heavy layer 4+ foam material 3, provided locally with cells). The cells 1, 1.1 to 1.4 are conveniently filled with air, but can also contain a gas filling, in which case the sound speed in the gas is advantageously higher than that in air. It is preferred to use foams with a dynamic modulus of elasticity of about 50,000 to 150,000 $Nm^{-2}$ and with a density of about 50 to 100 kg $m^{-3}$ for the foam material 3.

Instead of the foam material 3, other acoustically equivalent materials can be employed for the spring, in particular fibrous materials.

It is advantageous if the speeds of sound in the components of the spring which adjoin one another at the previously determined discontinuities, namely foam 3 and cells 1, 1.1 to 1.4, are in a ratio of at least 1:5, preferably 1:10 or more. The material of the foil 2 enclosing the hollow chambers 1, 1.1 to 1.4 is also of significance. The foil 2 advantageously has a mass of about 25 to 150 $gm^{-2}$ of surface.

What is claimed is:

1. A sound insulation part, comprising:

a body made of a resilient foam material, substantially defining the size and shape of the souond insulation part, and including an outward surface; and a cover layer secured on and covering the outward surface of the body;

the body forming a multitude of spaced cells inside the body, each cell including (i) an interior and an outside surface extending completely around said interior, (ii) flexible, gas impermeable foil held against the outside surface of the cell, and extending completely around and completely enclosing the interior of the cell, and (iii) a supply of gas captured by the foil in the interior of the cell;

the cells conducting sound at a rate faster than the rate at which the body conducts sound, wherein the cells convert sound sources into sound sinks.

2. A sound insulstion part according to claim 1, wherein:

each foil has a mass and a surface area, and the ratio of the mass to the surface is between about 25 to 150 grams/square meter.

3. A sound insulation part according to claim 1, wherein the gas is air.

4. A sound insluation part according to claim 1, wherein the gas is captured by the foil conducts sound at a rate faster than the rate at which air conducts sound.

5. A sound insulation part according to claim 1, wherein the resilient foam material has a dynamic modulus of elasticity of about 50 to $150\times10^3$ $Nm^{-2}$ and a density of about 50 to 100 $kg/m^3$.

6. A sound insulation part according to claim 1, for use with a body panel of an automotive vehicle, and wherein the cells are located adjacent said panel.

7. A sound insulation part according to claim 1, wherein the cells are located closely adjacent the cover layer.

8. A sound inslulation part according to claim 1, wherein:

the foam is made in a mold; and the cells are made by forming the foam around the cells as the foam is made.

9. A sound insulation part according to claim 1, wherein:

the sound insulation part includes first and second sections;

all of the cells are located in the first section of the body;

sound is conducted throught the first section of the body at a first rate;

sound is conducted through the second section of the body at a second rate;

the ratio of the second rate to the first rate is at least 5 to 1.

10. A sound insulation part, comprising:

a body made of a resilient fibrous material, substantially defining the size and shape of the sound insulation part, and including an outward surface; and a cover layer secured on and covering the outward surface of the body;

the body forming a multitude of spaced cells inside the body, each cell including (i) an interior and an outside surface extending completely around said interior, (ii) a flexible, gas impermeable foil held against the outside surface of the cell, and extending completely around and completely enclosing the interior of the cell, and (iii) a supply of gas captured by the foil in the cells conducting sound at a rate faster than the rate at which the body conducts sound, wherein the cells convert sound sources into sound sinks.

11. In an automotive vehicle including a passenger space having a plurality of sound sources and a plurality of sound sinks, and a wall extending along at least a part of the passenger space, a sound insulation part held against said wall and comprising a body made of a resilient foam materila, substantially defining the size and shape of the sound insulation part, and including an outward surface; and a cover layer secured on and covering the outward surface of the body;

the body including a multitude of spaced cells, each cell including (i) an interior and an outside surface extending completely around said interior, (ii) a flexible, gas impermeable foil held against the outside surface of the cell, and extending completely around and completely enclosing the interior of the cell, and (iii) a supply of gas captured by the foil in the interior of the cell;

the cells conducting sound at a rate faster than the rate at which the body conducts sound, wherein the cells convert sound sources into sound sinks; and the cells being arranged in the insulation part so that the distribution of sound sources and sound sinks in the passenger space is substantially uniform.

* * * * *

UNITED STATES PATENT AND TRADEMARK OFFICE

CERTIFICATE OF CORRECTION

PATENT NO. : 4,705,139

DATED : November 10, 1987

INVENTOR(S) : Heinemann Gahlau, et al.

It is certified that error appears in the above-identified patent and that said Letters Patent is hereby corrected as shown below:

In the Abstract, line 10: "coils (2)" should read as --foils (2)--

Column 5, Claim 1, line 41: "souond" should read as --sound--

Column 5, Claim 2, line 57: "inslulation" should read as --insulation--

Column 6, Claim 8, line 8; "inslulation" should read as --insulation--

Column 6, Claim 11, line 47: "materila" should read as --material--

Signed and Sealed this

Fourteenth Day of June, 1988

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,705,139

DATED : November 10, 1987

INVENTOR(S) : Heinemann Gahlau, et al.

It is certified that error appears in the above-identified patent and that said Letters Patent is hereby corrected as shown below:

Column 6, Claim 10, line 38: "gas captured by the foil in" should read as --gas captured by the foil in the interior of the cell;--

Signed and Sealed this

Sixth Day of September, 1988

*Attest:*

DONALD J. QUIGG

*Attesting Officer*

*Commissioner of Patents and Trademarks*